United States Patent [19]

Paulett

[11] 4,140,620

[45] Feb. 20, 1979

[54] INCREMENTAL DILUTION DEWAXING PROCESS

[75] Inventor: Grover S. Paulett, Houston, Tex.

[73] Assignee: Texaco Inc., New York, N.Y.

[21] Appl. No.: 813,138

[22] Filed: Jul. 5, 1977

[51] Int. Cl.[2] ..... C01G 43/08

[52] U.S. Cl. ..... 208/33; 208/38

[58] Field of Search ..... 208/33, 38

[56] References Cited

U.S. PATENT DOCUMENTS

| | | | |
|---|---|---|---|
| 2,410,483 | 11/1946 | Dons et al. | 208/33 |
| 3,644,195 | 2/1972 | Gudelis et al. | 208/33 |
| 3,850,740 | 11/1974 | Gudelis et al. | 208/33 |
| 4,013,542 | 3/1977 | Gudelis et al. | 208/23 |

*Primary Examiner*—Herbert Levine

*Attorney, Agent, or Firm*—Thomas H. Whaley; Carl G. Ries

[57] ABSTRACT

An incremental dilution dewaxing process for lubricating oil stocks in which the base stock, at a temperature above its cloud point, is cooled with vigorous agitation to a temperature below its cloud point and then further cooled with minimum agitation and incremental solvent addition to its final temperature, followed by filtration for the removal of wax. In this process, rapid stirring is provided during the early part of the cooling period. When the base stock has been cooled with relatively rapid agitation to a temperature below its cloud point, solvent is added to the base stock and mixed therewith and thereafter the mixture is cooled to the final or filtration temperature with essentially minimum agitation of the oil-solvent-wax mixture. It is not necessary for the solvent to be at a temperature below the temperature of the base stock or that of the oil-solvent mixture.

6 Claims, 1 Drawing Figure

INCREMENTAL DILUTION DEWAXING PROCESS

BACKGROUND OF THE INVENTION

1. Field of the Invention

This invention relates to a process for solvent dewaxing waxy petroleum oils by an improved incremental dilution method. In one of its more specific aspects, the process comprises cooling the lubricating oil base stock, with or without predilution with solvent, with vigorous agitation during the early stages of cooling, i.e. to a temperature below its cloud point. The cooling then may be continued with incremental solvent addition in a conventional manner to the desired final filtration temperature. The present process results in the formation of wax crystals which have improved filter rates, and in improved dewaxed oils yields as compared with conventional incremental dilution methods. The process may be carried out in plants having existing scraped wall chillers modified as described hereinafter, with a minimum of investment, as the process requires no special crystallizer.

2. Description of the Prior Art

The incremental dilution method of solvent dewaxing of waxy petroleum lubricating oil base stock is a common industrial technique. In this method, a suitable solvent is added to the oil base stock at several points during the chilling process. The waxy oil may be chilled at the rate of 1 to 5° F per minute. Suitable solvents, for example, propane, mixtures of methyl ethyl ketone (MEK) and toluene, mixtures of dichloromethane and dichloroethylene, and the like, are added to the base stock and to the resulting petroleum oil-solvent mixture as cooling progresses. The process is usually carried out in double walled tubular heat exchangers provided with mechanical scrapers in the inner conduit and means for supplying cooling medium to the annulus.

In the conventional incremental dilution method, the temperature of the solvent preferably is at or slightly above that of the oil or the oil-solvent mix at the point of addition. If the solvent is at a lower temperature, undesirable shock chilling occurs resulting in the formation of numerous small wax crystals, and if it is too high, it adds unnecessary additional heat load to the scraped surface exchangers. Capacity of a given solvent dewaxing unit often is limited by the heat exchange surface in the chillers.

It is known from U.S. Pat. No. 3,642,609, and related patents, that intensive agitation of a waxy petroleum oil stock accompanied by dilution chilling and the stimultaneous incremental addition of cold solvent to the system gives high rates of filtration of the resulting wax crystals from the oil with good yields of dewaxed oil. Special equipment is required for the cooling and dilution operations.

SUMMARY OF THE INVENTION

In the present invention, it has been found that stirring the charge oil or oil-solvent mixture in the early stages of cooling in the incremental dilution process substantially improves cycle rates and gives dewaxed oil yields comparable to the dilution chilling method of dewaxing oils. In the method of the present invention, waxy petroleum oil at a temperature above its cloud point is introduced into a cooling zone, suitably a conventional double wall heat exchanger provided with means for stirring the oil during cooling, ahd cooled to a temperature below its cloud point. Typically, the cooling rate is within the range of 1 to 8° F., per minute, perferably within the range of 1.5 to 5° F per minute. The oil is cooled with agitation to a temperature in the range of 5° F to 10° F., below its cloud point, i.e. until wax crystals begin to form. Solvent is then added incrementally to the chilled oil in known manner. The initial chilling of the oil with mixing during cooling to the cloud point temperature is the most important step in the process, as it determines the size, shape, and number of wax crystals formed, which, in turn, results in increased oil yields and increased filter rates. Following the initial chilling step, cooling of the mixture is continued with addition of solvent and with minimum stirring until the final or filtration temperature is reached.

The process of this invention is generally applicable to various solvent dewaxing systems, such as propane dewaxing, or well known solvent dewaxing operations employing as dewaxing solvent a mixture of a mineral oil solvent, such as an aromatic hydrocarbon, e.g. benzene, toluene and the like, and a wax anti-solvent, such as a normally liquid aliphatic ketone containing from 3–9 carbon atoms per molecule e.g., acetone, methylethylketone, methylisobutylketone, methyl-n-propylketone, and the like. Usually, the preferred aliphatic ketone is methylethylketone or methylisobutylketone and the preferred aromatic hydrocarbon is toluene. The process is applicable also to other solvent systems, e.g. mixtures of dichloromethane. Such solvent systems are well known in the art.

In the practice of this invention, the feed material undergoing dewaxing is subjected to agitation or stirring during cooling through the initial temperature range from above its cloud point to a temperature just below the cloud point, e.g. a temperature in the range of 5 to 10° F below the cloud point. By cloud point is meant that temperature at which crystals or precipitated solid material first begin to appear in the oil as indicated by observation of a visible haze therein. The cloud point is usually determined in a laboratory under standard ASTM test conditions.

The petroleum oil base stock undergoing treatment in the dewaxing operation described herein may be diluted with solvent, if necessary, during the initial cooling operation. It will be understood that the cloud point of the mixture of oil and solvent, in the case where the oil base stock is prediluted with a portion of the dewaxed solvent, will be lower than the cloud point for the undiluted base stock. This lowered cloud point is sometimes referred to as the depressed cloud point of the oil. The cloud point for any particular dilution or mixture of solvent and petroleum base stock may be determined in the laboratory and these results translated to plant operation. Some predilution of the base stock is desirable when high viscosity base stocks are treated. In such cases, sufficient solvent is added to base stock prior to or during the initial chilling period to maintain allowable viscosities and associated pressure drops within the heat exchange equipment. In any case, the major portion of the solvent is added to the system after the initial wax crystals have formed i.e. after the temperature of the oil base stock, with or without dilution, has reached a temperature slightly below the cloud point of the waxy petroleum fraction.

Following the initial chilling operation which is carried out in the presence of mixing or agitation, the resulting chilled admixture of waxy petroleum oil containing wax crystals therein, is gradually cooled with substantially reduced agitation, e.g. by cooling in scraped wall double pipe heat exchangers in conventional manner and with addition of solvent. Further, cooling of the waxy admixture of oil containing wax crystals and dewaxing solvent subsequent to the initial stirred cooling step is carried out under substantially non-turbulent flow conditions at a normal rate, e.g. at a cooling rate in the range of 1 to 8° F per minute, suitably 4 to 5° F per minute, to the final dewaxing temperature, e.g. a temperature in the range of 20° to −40° F. The resulting admixture of dewaxing solvent and waxy petroleum oil containing wax crystals therein is subjected to filtration, preferably by means of a vacuum rotary filter wherein the mixture of oil and solvent is drawn through the filter medium, the solid wax being retained on the filter as a wax cake, which is subsequently washed and removed from the filter in a continuous manner.

BRIEF DISCUSSION OF THE DRAWING

The FIGURE is a diagrammatic representation of a preferred embodiment of the process of the invention.

DESCRIPTION OF THE PREFERRED EMBODIMENT

Figure 1:
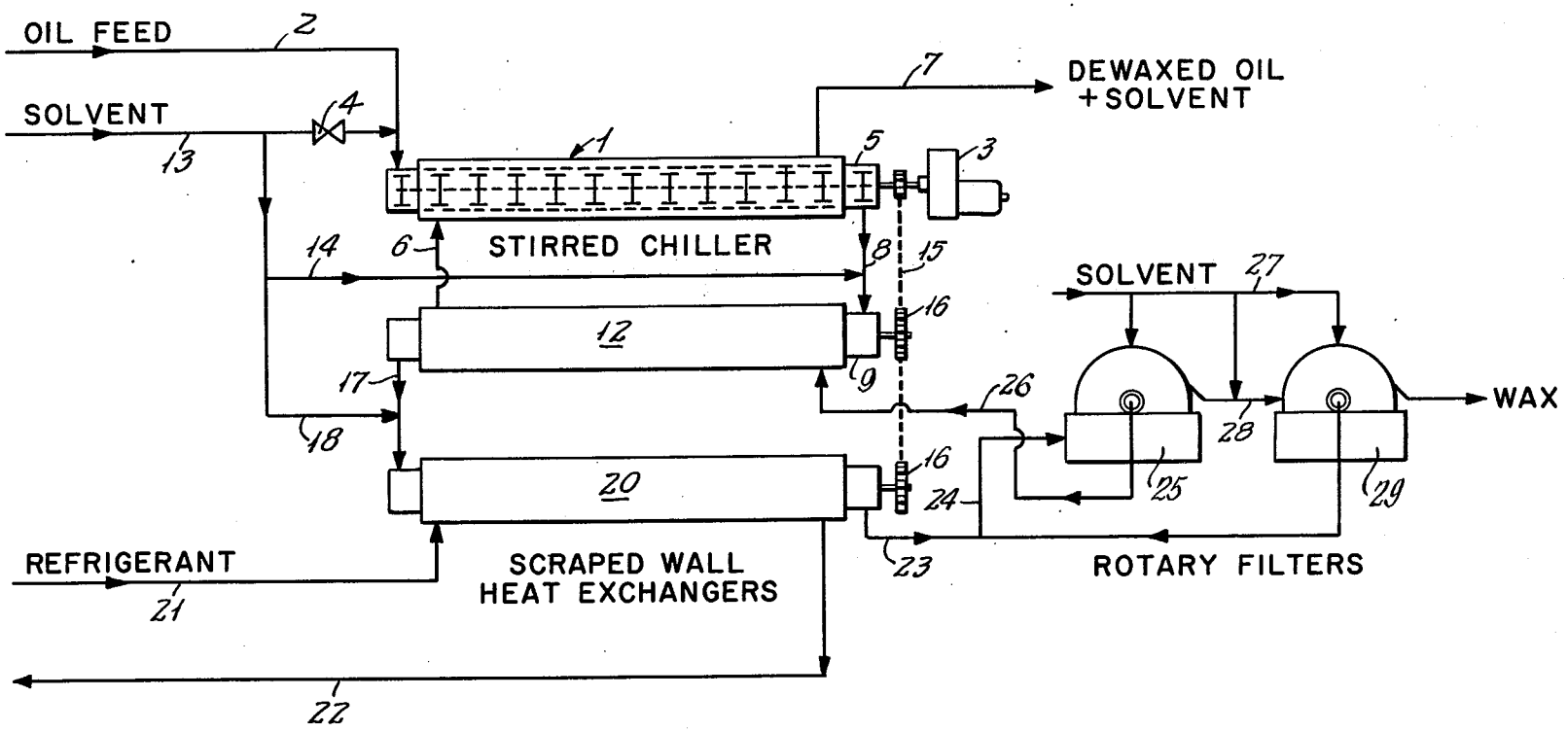

Referring now in detail to the figure, a waxy petroleum distillate is introduced into cooling and mixing zone or stirred chiller 1 through line 2, the oil feed entering inner pipe 5 of the zone 1. Suitably, zone 1 consists of a double pipe chiller which comprises an inner pipe jacketed by an outer pipe of larger diameter. A suitable mechanical stirrer is provided within the inner pipe and driven by a suitable motor and speed reducer drive mechanism 3. The stirred chiller may comprise a scraped wall double pipe heat exchanger with the scrapers operated at a sufficient rate to provide good stirring of the oil within the inner pipe of the heat exchanger. Solvent for predilution of the oil, if desired, may be introduced to the chiller through valve 4, from a suitable source as described hereinafter.

Coolant comprising cold filtrate from a rotary drum vacuum filter, as described later, is supplied to the jacket of chiller 1 through line 6 and the resulting warmed dewaxed oil and solvent mixture discharged through line 7 to a separation and solvent recovery system, not illustrated. The oil feed stock is cooled with continuous stirring to a temperature slightly below (e.g. 5° to 10° F below) its cloud point. The chilled oil stock containing small wax crystals is discharged from zone 1 through line 8 to the inner pipe 9 of a scraped wall double pipe heat exchanger 12. Solvent from line 13 is introduced through line 14 into line 8 where it is mixed with the oil stock. The temperature of the solvent is not critical to the operation of the process. The resulting mixture is then cooled in heat exchanger 12. Scraped wall heat exchangers are well known in the art. Mechanical scrapers inside pipe 9 of heat exchanger 12 are driven by motor 3, drive chain 15 and sprockets 16 to scrape the inside wall of pipe 9 and prevent the buildup of wax thereon.

Chilled oil-solvent mixture containing solid wax entrained and dispersed therein is discharged from heat exchanger 12 through line 17 and admixed with additional solvent supplied from line 13 through line 18. The resulting oil-solvent mixture is further cooled in scraped wall heat exchanger 20 to the desired filtration temperature by a suitable refrigerant supplied to heat exchanger through line 21 and discharged therefrom through line 22.

It is to be understood that chiller 2 and heat exchangers 12 and 20 in the drawing represent a group of heat exchangers of the double pipe type, typically comprising some 20 to 24 double pipe exchangers arranged in four parallel banks. Scraped wall heat exchangers are well known. It is contemplated that the stirred chiller 2, which, per se, forms no part of this invention, in practice will usually be a scraped wall heat exchanger modified to permit rapid rotation of the scrapers to ensure turbulent mixing in the inner pipe 5 of the chiller.

Solvents which may be employed in the process of this invention include, for example, mixtures of methylethyl ketone and toluene, mixtures of methylisobutyl ketone and toluene, mixtures of dichloroethylene and methylene chloride, and the like.

Upon reaching the final dewaxing temperature, which may be in the range of 20° F to −40° F., the resulting mixture comprising dewaxing solvent, dewaxed oil and entrained precipitated wax crystals is discharged through lines 23 and 24 to filter 25 where it is subjected to filtration, preferably by means of a rotary drum type vacuum filter wherein the mixture of oil and dewaxing solvent is drawn through the filter and solid wax is retained on the filter. Filtrate, comprising a mixture of dewaxed oil and dewaxing solvent is drawn from filter 25 and passed through line 26 to the outer pipe jacket heat exchanger 12. The wax cake is washed on the filter with cold solvent from line 27, continuously removed from the filter, mixed with solvent from line 27 and supplied through line 28 to repulping filter 29 wherein oil retained in the wax cake from filter 25 is recovered from the wax. The filtrate from filter 29 is combined with the chilled mixture from line 23 and sent to filter 25 through line 24. The filtrate oil-solvent mixture from filter 25 flows in sequence through heat exchangers 12 and 1, via connecting line 6 and is passed through line 7 to a suitable solvent recovery system, not illustrated.

EXAMPLES

The process of this invention is further illustrated by the following examples. In these examples a waxy distillate fraction from a vacuum tower, designated Wax Distillate WD-20, was employed as feed stock for solvent dewaxing process tests. The waxy distillate had the properties tabulated in Table I, below:

TABLE I

| PROPERTIES OF WAX DISTILLATE WD-20 | |
|---|---|
| Viscosity, SUS a 100° F | 254 |
| SUS a 210° F | 50.8 |
| Viscosity Index | 109 |
| Pour Point, ° F | 110 |
| Cloud Point, ° F | 115 |
| Wax Content, wt.% (Hexone) | 12.9 |
| API Gravity | 31.0 |

EXAMPLE I

Comparative tests were made in a laboratory batch unit provided with means for stirring at various rates, cooling means, and means for solvent addition at selected temperatures, wherein conditions in various commercial solvent dewaxing systems could be simulated for comparison purposes. Wax Distillate (WD-20) and a solvent mixture of 60 volume percent methylethyl ketone (MEK) and 40 volume percent toluene were used in the tests of this example.

Three systems were simulated:

A — Scraped Wall: Conventional incremental dilution with solvent in a scraped wall heat exchanger system.

B — Dilution Chilling: Simultaneous dilution and chilling of the waxy oil with cold solvent (−'to −50° F) under conditions of intensive agitation.

C.— Present Method: The method of this invention with normal cooling rates and with vigorous agitation only during the initial cooling period as described hereinabove.

The results of these tests are shown in Table II.

TABLE II

COMPARISON OF DIFFERENT DEWAXING METHODS WITH WD-20

WASH RATIO 0.65

| Run No. | Method | Wax Cake Thickness | Dilution Ratio | Cooling Rate ° F/Min. | DWO Yield Vol. % | Cycle Rate Gal. $DWO_2$ Hr./Ft. |
|---|---|---|---|---|---|---|
| A-1 | Scraped Wall | 8/32 | 2.5 | 1.5 | 70 | 10.6 |
| A-2 | Scraped Wall | 8/32 | 2.0 | 1.5 | 66.5 | 4.0 |
| B-1 | Dilution Chilling | 8/32 | 2.5 | 1.5 | 77 | 12.4 |
| B-2 | Dilution Chilling | 8/32 | 2.0 | 1.5 | 77 | 12.4 |
| C-1 | Present Method | 8/32 | 2.5 | 4.0 | 75 | 17.2 |
| C-2 | Present Method | 6/32 | 2.0 | 4.0 | 75 | 13.6 |

The following are definitions of the legends appearing in Table II above and Table III below.

Wax Cake Thickness: Thickness of wax cake on primary filter.

Dilution Ratio: Volumes solvent mixture per volume waxy oil charge stock used for dilution of the oil charge stock.

DWO Yield: The percentage of the charge oil by volume that is recovered as dewaxed oil product.

Cycle Rate: The number of gallons of dewaxed oil recovered from the filter per hour per square foot of filter surface.

Wash Ratio: The volume of solvent per volume of oil feed stock employed in washing the wax cake on the filter.

Total Dilution Ratio: Total volumes of solvent per volume of oil feed stock (the sum of the Dilution Ratio and the Wash Ratio).

It will be evident from consideration of the results of Table II above that the subject method permits considerably higher cycle rates at a given dilution ratio and fixed wash ratio (0.65) than either of the commercial processes with which comparisons were made. The DWO yields represent the recovery of dewaxed oil from a single filtration. Further amounts of oil may be recovered from the waxy by a repulping operation as described above. The commercially important improvement in dewaxing operations which results when the operations are conducted in accordance with the method of this invention is the high cycle rates which may be achieved. This permits higher throughput of oil for any given installation of heat exchangers and filters.

EXAMPLE II

In another series of tests comparable to those described in connection with Example 1, conditions were determined for the same three systems to produce an 80 volume percent yield of dewaxed oil. As in Example I the oil feed stock was WD-20 and the solvent mixture 40 volume percent MEK and 60 volume percent toluene. The results of these tests are shown in Table III.

It will be evident from a consideration of the results of the test results summarized in Table III that the method of this invention gives improved cycle rates, hence improved throughput, as compared with the other commercial processes, when operated to produce a given dewaxed oil yield (80 volume percent).

TABLE III

COMPARISON OF DIFFERENT DEWAXING METHODS WITH WD-20
80 Vol. % DWO Yield

| Run No. | Method | Wax Cake Thickness | Dilution Ratio | Cooling Rate ° F/Min. | Wash Ratio | Cycle Rate Gal. $DWO_2$ Hr./Ft. | Total Dilution Ratio |
|---|---|---|---|---|---|---|---|
| A-3 | Scraped Wall | 8/32 | 2.5 | 1.5 | 1.6 | 5.6 | 4.1 |
| A-4 | Scraped Wall | 8/32 | 2.0 | 1.5 | 1.8 | 2.2 | 3.8 |
| B-3 | Dilution Chilling | 8/32 | 2.5 | 1.5 | 0.95 | 10.8 | 3.45 |
| B-4 | Dilution Chilling | 8/32 | 2.0 | 1.5 | 0.9 | 9.2 | 2.9 |
| C-3 | Present Method | 8/32 | 2.5 | 4.0 | 1.15 | 18.2 | 3.65 |
| C-4 | Present Method | 6/32 | 2.0 | 4.0 | 1.15 | 14.1 | 3.15 |

What is claimed is:

1. In a process for dewaxing a waxy lubricating oil stock by cooling said oil stock in the presence of a dewaxing solvent to a temperature effective for removal of wax therefrom by filtration wherein said oil stock optionally diluted with a minor portion of said dewaxing solvent is cooled and dewaxing solvent is incrementally added to the oil stock during cooling, the improvement comprising introducing said oil stock at a temperature above its cloud point into a cooling zone, cooling and vigorously agitating said oil in said cooling zone without addition of solvent to a temperature below the cloud point of said oil stock, introducing incrementally at least the major portion of said dewaxing solvent into admixture with said oil stock after the temperature of said oil stock is below said cloud point, further cooling resulting mixture of oil stock and solvent under conditions of substantially reduced agitation to dewaxing temperature, separating by filtration thus precipitated wax from resulting dewaxed oil in said mixture and recovering oil of diminished wax content therefrom.

2. The process of claim 1 wherein said initial cooling under conditions of intensive stirring of said oil stock is carried out to a temperature in the range of 5° to 10° F. below the cloud point of said oil.

3. The process of claim 1 wherein said oil stock is cooled at a rate of 1.5 to 5° F. per minute.

4. The process of claim 1 wherein said lubricating oil stock is admixed with 0.5 to 2.0 volumes of solvent per volume of oil prior to said initial cooling and cooled with agitation to a temperature in the range of 5° to 10° F. below its cloud point prior to the addition of further amounts of solvent.

5. The process of claim 1 wherein said solvent comprises a mixture of dialkyl ketone and toluene.

6. The process of claim 1 wherein said solvent comprises a mixture of dichloroethylene and methylene chloride.

* * * * *